United States Patent [19]

Klinkhammer

[11] B 3,986,879

[45] Oct. 19, 1976

[54] ROLL FASTENING FOR ROLL FILMS

[75] Inventor: Ralf L. Klinkhammer, Cologne, Germany

[73] Assignee: Agfa-Gevaert, A.G., Leverkusen, Germany

[22] Filed: Sept. 3, 1974

[21] Appl. No.: 503,029

[44] Published under the second Trial Voluntary Protest Program on January 27, 1976 as document No. B 503,029.

[30] Foreign Application Priority Data

Sept. 7, 1973 Germany ..... 2345260

[52] U.S. Cl. ..... 96/78

[51] Int. Cl.[2] ..... G03C 3/02

[58] Field of Search ..... 96/76 R, 77, 78; 206/316

[56] References Cited

UNITED STATES PATENTS

| | | | |
|---|---|---|---|
| 1,828,955 | 10/1931 | Bornmann | 96/78 |
| 1,944,132 | 1/1934 | Naewiger | 96/78 |
| 2,188,779 | 1/1940 | Roehrl | 96/78 |

*Primary Examiner*—Jack P. Brammer

*Attorney, Agent, or Firm*—Connolly and Hutz

[57] ABSTRACT

A roll fastening is based on the fact that the beginning of the film is stuck to the leader by means of an adhesive strip (film sticker). In this way, the outermost turn of the leader is lightly bonded to a preceding turn. To this end, a first hole is punched into the leader in the vicinity of the film sticker, so that part of the tacky surface of the film sticker remains exposed, and another hole with a larger surface area than the first hole is punched into the leader at the same level as and at a distance of $d.\pi$ (d = roll diameter) from the first hole.

2 Claims, 1 Drawing Figure

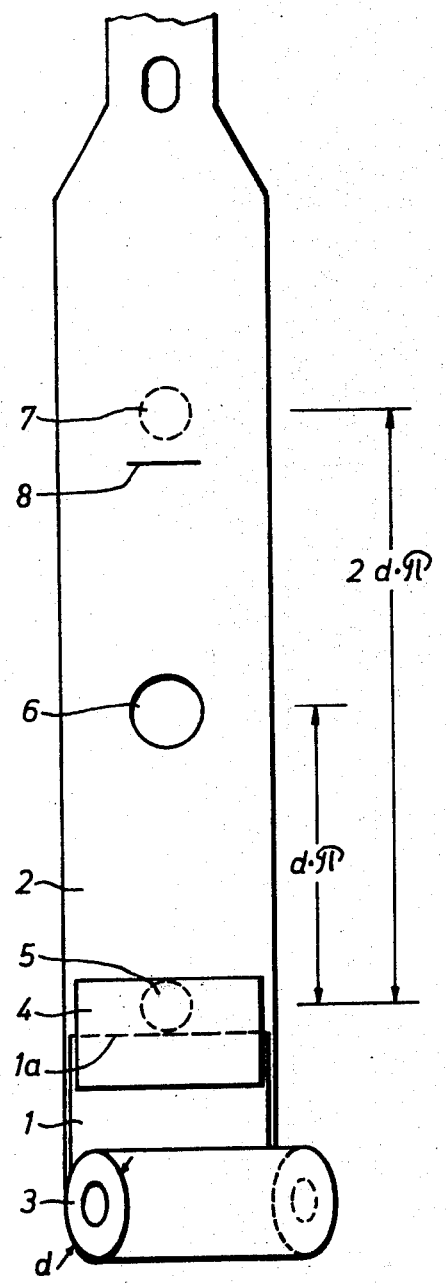
7
8
6
2
5
4
1a
1
3
d
2 d·π
d·π

ROLL FASTENING FOR ROLL FILMS

This invention relates to a roll fastening for roll films or cassette films with leaders. In such films, the beginning of the film is generally attached to the leader by means of an adhesive strip. Roll fastenings normally used for this purpose consist of a bond by which the outermost turn of the leader is lightly bonded to one of the last turns. The invention relates to an improvement in a fastening of this kind.

Roll films or cassette films are temporarily rolled up during further processing into the end product. To prevent the rolls from automatically unrolling, a roll fastening has to be applied. The simplest solution is a metal or plastics clip which holds the roll togethr and prevents it from unrolling. Unfortunately, clips of this kind are a disadvantage in cases where further processing is carried out automatically, because additional operations for affixing the clips and removing them again have to be introduced into the processing cycle.

Another known roll fastening uses an adhesive strip which is applied in the vicinity of the last turns. In this case, the adhesive strip is affixed over a punched hole in the leader. The underlying, exposed adhesive surface then joins the outer layer of the leader to the underlying layer, thus preventing the roll from automatically unrolling. The adhesive strip is generally applied by means of a punch-type bonding machine which transfers the strip to the leader passing through it in the vicinity of the punched hole. A contact-pressure roller provides for firm bonding in the finished roll.

A disadvantage of this procedure is that disturbances arise which affect the bonding machine and another major disadvantage is that interruptions (dead times) are necessary in its operation for changing the adhesive roll. Disturbances can be caused by deposits of adhesive and detached adhesive strips. In many cases, the bond strength of the strip on the lacquered upper surface of the leader is too weak, with the result that the rolls unroll during further processing.

During further processing, the rolls are partly unrolled again. In many cases, the leader tears at the bond when the first layer thereof is removed. Tears of this kind frequently give rise to difficulties during film transport in the camera and, hence, to consumer complaints.

An object of the present invention is to improve this type of roll fastening in such a way that the outlay involved in terms of labour and materials is reduced and the reliability of the roll fastening increased. Another object of the invention is to eliminate the sources of error referred to above.

According to the invention, there is provided a roll fastening for roll films or cassette films having a leader, in which the beginning of the film is stuck to the leader by means of an adhesive strip which forms a bond by which the outermost turn of the leader is lightly bonded to a preceding turn, wherein a first hole is punched into a region of the leader which is in contact with the adhesive strip, so that part of the tacky surface of the adhesive strip is exposed, and a second hole with a larger surface area than the first hole is punched into the leader at the same lateral position as and at a distance $d.\ \pi$ ($d$ = roll diameter) from the first hole.

Peferably the beginning of the leader is provided with an incision, whose length is greater than the diameter of the first punched hole, at the same lateral position as and at a distance approximately $2d\ \pi$ - 10% from the first punched hole.

The major advantage of the invention is that no additional adhesive strips are required for fastening the roll. Accordingly, there is also no longer any need for the bonding machine which is otherwise needed to apply the additional adhesive strips. In contrast to the prior art, bonding takes place on the underneath of the leader. It has surprisingly been found that the bond strength is greater on the underneath of the leader than on its upper surface, so that the new roll fastening is also more reliable.

A serious further-processing fault which can be caused by automatic winding machines is the absence of the so-called film sticker. In this case, the beginning of the film is no longer stuck to the leader. In most cases, this fault is only discovered by the consumer and gives rise to consumer complaints. In the roll fastening according to the invention, the roll of film automatically unrolls on leaving the automatic winding machine if the film sticker is missing. In this way, defective rolls can be immediately separated out.

In addition, the positioning of the incision which prevents tear propagation at a distance of $2\ d\ \pi$ - 10% from the first punch hole reduces damage to the leaders at the incision.

One embodiment of the invention is described below by way of example with reference to the accompanying drawing. The Figure shows a roll of film in which the first turns have been unwound. The film 1 is rolled up together with the leader 2 on the spool 3. The beginning 1*a* of the film is joined to the leader 2 by a film sticker 4. A circular hole 5 is punched into the leader 2 in the vicinity of the film sticker. A circular portion of the adhesive layer of the film sticker 4 is thus exposed through the upper surface of the leader (in the drawing this corresponds to the back of the leader). An auxiliary hole 6 is punched into the leader 2 at the same lateral position as and at a distance $d.\pi$ from the first hole 5. The hole 6 is slightly larger in diameter than the first hole 5. The hole 6 prevents the next turn after the film sticker 4 from being joined to the underlying turn. It is only the next turn and one which is bonded to the film sticker 4. Accordingly, the surface 7 on which this bond takes place is situated at a distance $2\ d.\ \pi$ from the film sticker 4. The hole 6 is positioned exactly over the tacky part of the first hole 5 during rolling of the film. As rolling progresses, the surface 7 on the underneath of the leader (front side in the drawing) is bonded through the hole 6 to the exposed tacky surface 5 of the film sticker 4.

The leader 2 is provided with an incision 8 a few millimeters before the surface 7 which comes to rest on the tacky surface 5 during winding of the film. The incision is made at right angles to the longitudinal axis of the leader. Its length is slightly greater than the diameter of the tacky surface 5. Its function is to prevent the leader from tearing when the roll 3 is unrolled again and the bond broken. The piece torn off from the leader is thus limited and under no circumstances goes beyond the incision 8. The positioning of the incision relative to the tacky surface 7 is not critical. The incision 8 is best made at a distance $2\ d.\ \pi$ - 10% from the first punched hole 5.

The roll fastening according to the invention is extremely reliable. In addition to saving material, there is now no longer any need for the additional operation for applying a separate adhesive strip.

What we claim is:

1. A roll fastening for roll films or cassette films comprising a leader having an outer end and a lateral width, in which the beginning of the film is stuck to the leader a short distance from its outer end by means of an adhesive strip, wherein a first hole is punched into a region of the leader which is in contact with the adhesive strip so that part of the tacky surface of the adhesive strip is exposed, and a second hole with a larger surface area than the first hole is punched into the leader at the same lateral position as and at a distance $d.\pi$ ($d$ = roll diameter) from the first hole between the first hole and the outer end of the leader to prevent the first turn of the leader from sticking to the exposed tacky surface of the adhesive strip and whereby the second turn sticks to the tacky surface of the adhesive strip which is exposed through the first and second holes to form a bond by which the outermost turn of the leader is lightly bonded about the roll.

2. A roll fastening as claimed in claim 1, wherein the leader is provided with an incision whose length is greater than the diameter of the first hole, the incision being substantially at the same lateral position as the holes and at a distance of approximately $2\ d.\ \pi$ - 10% from the first hole toward the outer end at the leader whereby the extent of a piece torn off the leader when the bond is broken is limited.

* * * * *